US009797077B2

(12) United States Patent
Cerliani

(10) Patent No.: US 9,797,077 B2
(45) Date of Patent: Oct. 24, 2017

(54) HOOK FOR LOCKSTITCH SEWING MACHINE COMPRISING A BOBBIN CASE WITH A SLIDE COMPOSED OF MULTIPLE COMPONENTS

(71) Applicant: CM CERLIANI S.R.L., Pavia (IT)

(72) Inventor: Daniele Cerliani, Pavia (IT)

(73) Assignee: CM CERLIANI S.R.L., Pavia (IT)

( * ) Notice: Subject to any disclaimer, the term of this patent is extended or adjusted under 35 U.S.C. 154(b) by 0 days.

(21) Appl. No.: 15/013,591

(22) Filed: Feb. 2, 2016

(65) Prior Publication Data

US 2016/0230321 A1 Aug. 11, 2016

(30) Foreign Application Priority Data

Feb. 9, 2015 (IT) ..... M12015A0178

(51) Int. Cl.
*D05B 57/14* (2006.01)
*D05B 57/16* (2006.01)
*D05B 57/26* (2006.01)

(52) U.S. Cl.
CPC ..... *D05B 57/143* (2013.01); *D05B 57/14* (2013.01); *D05B 57/16* (2013.01); *D05B 57/265* (2013.01)

(58) Field of Classification Search
CPC ..... D05B 57/143; D05B 57/14; D05B 57/16; D05B 57/265
See application file for complete search history.

(56) References Cited

U.S. PATENT DOCUMENTS 2,949,874 A * 8/1960 Kuhar ..... D05B 57/26 112/231
2,974,618 A * 3/1961 Kuhar ..... D05B 57/26 112/231
3,199,480 A * 8/1965 Covert ..... D05B 57/14 112/181
3,373,707 A * 3/1968 Ketterer ..... D05B 57/143 112/184
3,682,121 A * 8/1972 Kasawaki ..... D05B 57/26 112/231
5,048,436 A 9/1991 Thiele
(Continued)

FOREIGN PATENT DOCUMENTS

DE 39 11 134 A1 10/1990
EP 0 457 376 A2 11/1991
(Continued)

OTHER PUBLICATIONS

Italian Search Report, dated Sep. 22, 2015, from corresponding Italian Application.

*Primary Examiner* — Danny Worrell
(74) *Attorney, Agent, or Firm* — Young & Thompson

(57) ABSTRACT

Hook for lockstitch sewing machine, both of the rotary type and of the Central Bobbin type (CB-shuttle or CB-hook), which includes a bobbin case (508, 708, 808, 908, 1008, 1108, 1208) with an improved slide, composed of multiple components, including a slide body (515*a*, 615*a*, 715*a*, 815*a*, 915*a*, 1115*a*, 1215*a*) which performs entirely the functions of guiding the slide on the bobbin case and of creation of the leverage with the lever (16, 16*b*), and at least one secondary component (582, 782, 882, 982, 1182, 1286), fixed to the slide body and apt to perform the function of slide's claw or guide and/or protection of the thread.

11 Claims, 19 Drawing Sheets

(56) References Cited

U.S. PATENT DOCUMENTS

| | | | | | |
|---|---|---|---|---|---|
| 5,375,544 | A | * | 12/1994 | Badillo | D05B 57/26 112/231 |
| 5,651,323 | A | * | 7/1997 | Hirose | D05B 57/16 112/231 |
| 5,960,728 | A | * | 10/1999 | Hirose | D05B 57/14 112/231 |
| 6,076,477 | A | * | 6/2000 | Badillo | D05B 57/26 112/231 |
| 6,776,111 | B2 | * | 8/2004 | Lee | D05B 57/26 112/231 |

FOREIGN PATENT DOCUMENTS

| | | | |
|---|---|---|---|
| KR | 200395794 | Y1 | 9/2005 |
| WO | 2014/035132 | A2 | 3/2014 |

* cited by examiner

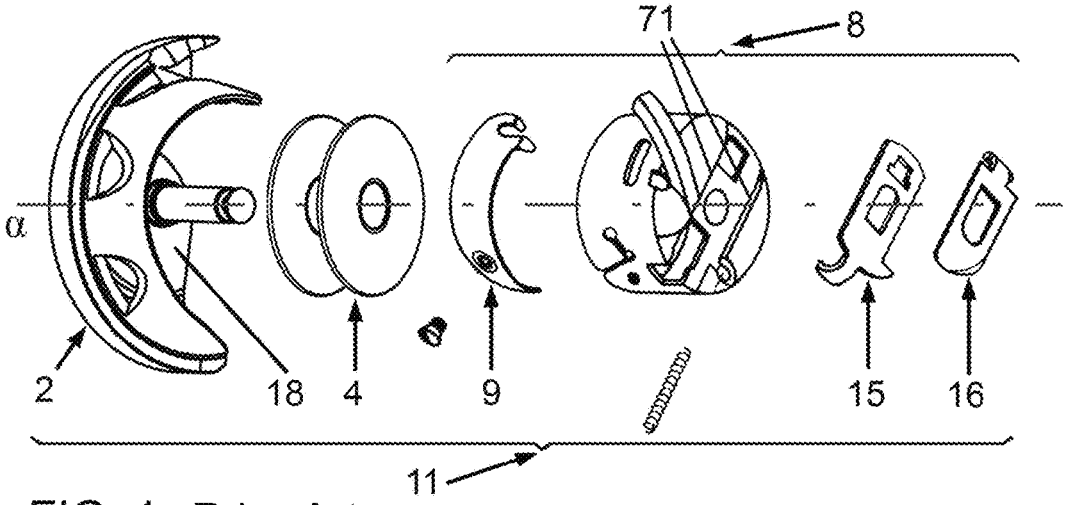
FIG. 1 - Prior Art
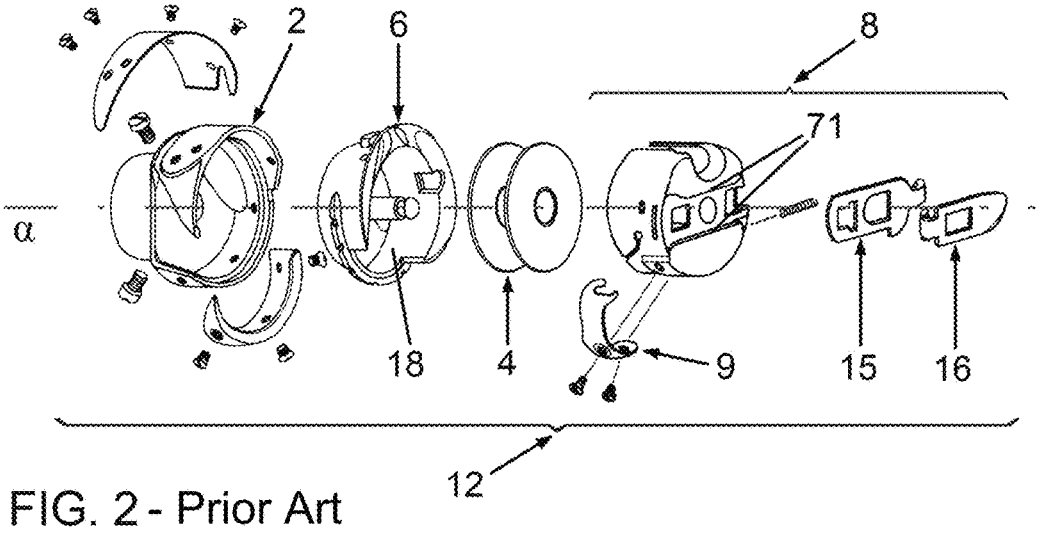
FIG. 2 - Prior Art

HOOK FOR LOCKSTITCH SEWING MACHINE COMPRISING A BOBBIN CASE WITH A SLIDE COMPOSED OF MULTIPLE COMPONENTS

FIELD OF THE INVENTION

The present invention relates to a hook for lockstitch sewing machine (with a needle thread and a bobbin thread), both of the rotary type (rotary hook) and of the Central Bobbin type (CB-hook or CB-shuttle or shuttle) and suitable for both household and industrial sewing machines, which comprises a bobbin case with an improved slide, composed of multiple components, in order to provide new performances than those attainable with the state of the art where the slide is composed of one single mechanical part.

The invention relates further to a lockstitch sewing machine comprising such hook comprising such bobbin case with a slide composed of multiple components, in order to provide new performances than those attainable with the state of the art.

The bobbin case with the improved slide can be used in place of the known bobbin case that, depending on the executions, is mounted respectively on the basket, in the case of a rotary hook, or directly on the hook, in the case of a CB-hook.

BACKGROUND OF THE INVENTION

Lockstitch sewing machines and related rotary hooks or CB-hooks are well known and therefore will not be described herein, where we simply remember schematically the composition of the hooks in which the lockstitch is formed between the bobbin thread (wound around the bobbin contained in the hook) and the needle thread, which at each stitch, must wrap the bobbin with its loop.

The rotary hook, in execution with bobbin case, comprises at least one hook body, which is connected to a shaft from which it receives motion and comprises a circular cavity of the hook body, a basket free to rotate inside the circular cavity of the hook body and which in turn comprises a well of the basket, a gib which helps to constrain the basket to the hook body and a bobbin case, which is housed in the well of the basket and which helps to constrain the bobbin to the basket.

The shaft can be integral with the body hook or housed in a hole present at the center of the circular cavity of the hook body.

The bobbin case containing the bobbin with the bobbin thread, is assembled and disassembled by the operator of the sewing machine at each change of the bobbin, through an axial translation, in which the outer diameter of the bobbin case is inserted inside the inner diameter of the well on the basket and the shaft of the well of the basket, if present, is inserted into the central hole of the shaft of the bobbin case (in fact there are some embodiments of the rotary hooks in which bobbin case and basket do not have the central shaft in order to allow the use of coreless bobbins), while an angular reference ensures its correct angular positioning with respect to the basket.

Very similar is the assembly and disassembly operation of the bobbin case in CB-hooks. However, the difference is that, since there is no basket, the bobbin case is bound directly to the shaft of the hook body formed in the circular cavity of the CB-hook body itself, instead on the basket as occurs in rotary hooks. For CB-hooks, this is the only way to constrain the bobbin case to the hook body, since the bobbin case must be free to rotate around said shaft of the hook body.

The axial constraint of the bobbin case on the basket (or respectively on the CB-hook body), to prevent accidental disassembly during the sewing operation, occurs by means of the slide of the bobbin case that engages itself on the basket (or respectively on the CB-hook body). The leverage created by the lever on the slide allows to retract and release the slide from the basket (or respectively from the CB-hook body) through the actuation of the lever, and then to release the bobbin case from the axial constraint to allow disassembly through an axial translation.

That axial restraint is provided by the interlock of the slide, in its position at rest, i.e. forward, in an undercut formed in the basket (or respectively in the CB-hook body): in rotary hooks in execution of the basket with shaft and in CB-hooks, this undercut is constituted by a groove on the shaft of the basket (or respectively on the shaft of the CB-hook body), which engages the edge of the central hole of the slide, while in the rotary hooks in execution of the basket without shaft (possible indeed only in rotary hooks), such undercut is constituted by a groove in the internal diameter of the well of the basket that engages the front end of the slide, in correspondence to the claw formed at one end of the slide (described later and in the following called slide's claw for simplicity), which, in the slide's position at rest, i.e. forward, protrudes from the outer diameter of the bobbin case. This protrusion from the bobbin case of the front end of the slide is also present on the bobbin case for CB-hooks, but in this case it cannot be used to constrain axially the bobbin case to the CB-hook because, in CB-hooks, the bobbin case, as said, must be free to rotate around the shaft of the hook body.

The slide in turn is constraint to the bobbin case by a guide that allows only its translational movement forward (position at rest in which the slide and the bobbin case are constrained to the basket or, respectively, to the hook body in the CB-hooks) and backward (disengagement position of the slide, in which it is possible the assembly and disassembly of the bobbin case from the basket or, respectively, from the hook body in the CB-hooks), where said backward position is reached consequently to the activation of the lever. The lever, by means of an interlock or of a pin that secures it to the slide, creates with said slide a leverage, which has the fulcrum on the bobbin case body. The whole set of slide and lever is also referred to as the latch. During the assembly, the lever is positioned in the working position, after the insertion of the slide into the guide on the bobbin case body, and while it creates the leverage, it also determines the backward and forward working stroke's end points of the slide. Note that in order to assemble the slide on the bobbin case through the insertion of the slide into the guide on the bobbin case, it is necessary to provide a through opening on the wall of the bobbin case for the passage of the slide's claw Said opening has the disadvantage to interrupt the continuity of the profile of the bobbin case to support the passage of the needle thread. Said slide's claw has the function to constrain temporarily the bobbin to the bobbin case, when the slide is retracted for the assembly and disassembly of the bobbin case on the basket (or respectively on the CB-hook body) in order to avoid that the bobbin falls out from the bobbin case during these operations. On the contrary, when the bobbin case is assembled and constrained on the basket (or respectively on the CB-hook body), and the slide is then in its forward position at rest, also the slide's claw is forward and leaves free to rotate within the bobbin case, for the sewing operation, the bobbin, which is now constrained axially by the basket (or respectively by the CB-hook body). When the slide is forward and at rest (as occurs during the sewing operation), the slide's claw protrudes from the outer diameter of the bobbin case and, in most cases of the rotary hooks, it—the slide's claw—is housed within a space formed in the wall of the basket, so to not hamper the passage of the needle thread, which during the sewing wraps the bobbin case and is supported in its passage by the basket. More critical instead is the passage of the needle thread over the bobbin case on CB-hooks and in some executions of the bobbin case on rotary hooks, on which the side wall of the basket in correspondence to the slide's claw is not present, as, not being there present the basket to offer support to the needle thread, said needle thread leans directly on the bobbin case and both said protrusion of the slide from the bobbin case and the interruption of the continuity of the profile of the bobbin case in correspondence to the through opening on the wall of the bobbin case, required to pass the slide's claw during the assembly operation of the slide, can represent an hindrance.

In order to avoid the slide's claw to protrude from the outer wall of the bobbin case at rest and to facilitate the passage of the needle thread loop during the sewing, in the bobbin cases for CB-hooks and in some executions of the bobbin case for rotary hooks, in which the wall of the basket in correspondence to the slide's claw is not present (as for example for the bobbin cases for the so-called WHEELER & WILSON rotary hook family or for the oversized bobbin cases designed to contain larger bobbins), the thickness of the wall of the bobbin case in correspondence to the slide's claw has been increased so to contain it entirely within said thickness: or the outer diameter of the bobbin case is eccentric with respect to the inner one, or the plan profile of the outer wall of the bobbin case is shaped, or a protuberance, even only partial, is present on the outer diameter of the bobbin case in correspondence to the slide's claw.

To allow the assembly of the slide on the bobbin case, however, the through opening on the wall of the bobbin case is always present. Said through opening represents always a hindrance to the passage of the needle thread loop during the sewing operation, as it offers an interrupted profile (and not continuous as is in the case of the wall of the basket), from which said needle thread is supported.

A possible solution to avoid the through-opening and therefore to continue to have a continuous profile even in absence of the basket's wall, is illustrated by the EP0457376B1 patent where it shows a different assembling system of the slide by means of partialization of one edge of the guide of the slide on the bobbin case and rotation of the slide on the other edge for the insertion of the slide into the guide during the assembly.

In the state of the art (and also in EP0457376B1 patent) the slide is constituted by one single component commonly obtained by shearing and bending of a metal sheet (followed by eventual operations of chips removal as milling) with a thickness generally of at least 1 mm, in order to give sufficient strength to the slide. The bending is necessary to obtain the slide's claw, which, seen from the side, comes to assume a shape of a "C". The internal profile of the "C" and its position with the slide at rest, are determined by the functional requirements related to the traverse travel stroke of the slide and the diameter of the bobbins to be constrained. Once so defined the internal profile of the slide's claw, the overall dimensions of such slide's claw towards the outside of the bobbin case, is consequence of the bending of the sheet and the thickness of the sheet itself. The thickness of the sheet is in turn determined by the functional requirements of the guide of the slide on the bobbin case and the leverage created with the lever and is usually of at least 1 mm, while for the sole slide's claw function also a much less thickness would be enough.

WO-A-2014/035132 describes a sewing machine hook that envisages various conformations of slides made always and only of one single piece. Also in FIGS. 5 and 6, the additional protuberance 550, is formed in one only piece with the slide 520.

Object of the present invention is to implement a hook comprising a bobbin case with an improved slide, composed of multiple components, in order to achieve new performances than those attainable at the state of the art in which the slide is made of one single mechanical part.

SUMMARY OF THE INVENTION

Substantially, the slide according to the invention is composed of multiple components in which there is a main one, which we will call the slide body and which performs entirely the functions of guiding the slide on the bobbin case for the translational movement forwards and backwards and of creation of the leverage with the lever for the actuation of said translation. The secondary components of the slide, which give an advantage if made separately from the slide body, in some preferred embodiments, can be relate to the realization of both the slide's claw and a possible guide and/or protection of the thread (usually the bobbin thread).

In a preferred embodiment, comprising at least one secondary component, that secondary component is fixed to the slide by gluing or clinching or riveting or interlocking or by means of one or more screws or by a combination of two or more of said systems.

In a preferred embodiment, comprising at least one secondary component, that secondary component is fixed to the slide body by means of an interlocking of the secondary component in a groove formed on the underside of the slide body. Such groove must have preferably at least one arm perpendicular to the translation direction of the slide, in order to be possible to transmit the translational movement forwards and backwards from the slide body to the secondary component.

In a preferred embodiment, comprising at least one secondary component fixed to the slide body by means of an interlock of the secondary component in a groove formed on the underside of the slide body, the secondary component is fixed in the interlock before the insertion of the slide body into the guide on the bobbin case and remains fixed there once the slide body is inserted into said guide.

In another preferred embodiment, comprising at least one secondary component fixed to the body slide by means of any one of the ways described, the secondary component is mounted on the slide body after insertion of the slide body into the guide on the bobbin case, or from the inside of the well of the bobbin case (the one where then the bobbin is housed), i.e. from under the slide, or otherwise from the outside of the bobbin case, i.e. from above the slide. Specifically, when the secondary component performs the function of slide's claw, this embodiment has the advantage to avoid the necessity of the through opening in the wall of the bobbin case to pass the slide's claw, during the insertion of the slide into the guide on the bobbin case and thereby to ensure the continuity of the profile of the bobbin case to support the passage of the needle thread. For this purpose, appropriate openings must be provided on the inner bottom of the bobbin case, which, in the case of assembly of the secondary component from the inside of the well of the bobbin case, are used to mount the entire secondary component on the slide body (already inserted into the guide of the bobbin case), while in the case of assembly of the secondary component from the outside, the openings are needed to pass only a portion of the secondary component from the outside to the inside of the bobbin case (for example, indeed the slide's claw).

In a preferred embodiment, comprising at least one secondary component fixed to the slide body by interlock and mounted on the slide body from the inside of the well of the bobbin case after the insertion of the slide body into the guide of the bobbin case, while the slide body is in a retracted position, said backward position may be also beyond the backwards working stroke's end point after that also the lever will have been mounted, so that this position may not be any more reached during the normal working stroke of the slide, so to leave the secondary component always constrained during normal operation of the slide and to prevent its accidental disassembly. For this purpose, appropriate openings must be provided on the inner bottom of the bobbin case, which are needed only to mount the secondary component from the inside of the bobbin case in the retracted position of the slide beyond its backwards working stroke's end point.

A preferred embodiment of the multiple components slide shows a flat slide body and a slide's claw made separately with a "C-bent" thin metal sheet and fixed to the slide body by means of any one of the indicated ways. The thickness of said metal sheet of the slide's claw can be much less than the thickness of the slide body since, as said, for the function of the slide's claw a much less thickness is sufficient than that necessary for the slide's guiding function on the bobbin case and for the creation of the leverage with the lever. The advantage of this embodiment is that the overall size of the slide's claw are greatly reduced and it can be housed in a less thick wall of the bobbin case.

In a preferred embodiment, comprising a component constituting the slide's claw and fixed to the slide by means of any one of the indicated ways, the sheet thickness of said component constituting the slide's claw, is less than 0.4 mm.

In a preferred embodiment, comprising a component constituting the slide's claw and fixed to the slide body by means of any one of the indicated ways, the front part of the slide body is longer than the maximum protrusion of the component constituting the slide's claw and, at the forward position at rest of the slide, said front part overlaps the opening in the wall of the bobbin case for the slide's claw, and cooperates herewith with the bobbin case wall to create the continuity of the profile, to support the passage of the needle tread, that the opening of the wall was interrupting.

In another preferred embodiment, comprising a secondary component constituting the slide's claw and fixed to the slide by means of any one of the indicated ways, said component constituting the slide's claw is mounted on the slide body after the insertion of the slide body into the guide on the bobbin case, preferably while the slide body is in a retracted position, or from the inside of the bobbin case's well (the one where the bobbin is then housed) or from the outside of the bobbin case. This embodiment avoids to have the through opening in the wall of the bobbin case, and it is sufficient a recess obtained in the thickness of said wall (said thickness being possibly increased in correspondence to the position of the slide's claw in one of the known ways and above described) to house the slide's claw in the forward position at rest of the slide, while the continuity of the profile of the bobbin case wall to support the passage of the needle thread is guaranteed.

In another preferred embodiment of the multiple components slide, to the slide is fixed by any one of the indicated ways, a secondary component, which performs the function of guide and/or protection of the thread.

In another preferred embodiment of the multiple components slide, comprising a secondary component, which performs the function of guide or protection of the thread and which is fixed to the slide body by means of any one of the described ways, said secondary component is fixed to the rear of the slide (opposite to the slide's claw) and has the function to guide and/or protect the bobbin thread in the rotary hooks designed for coreless bobbins, with bobbin cases and baskets without shaft, in which the bobbin thread exits from the center of the bobbin case and passes between the slide body and the lever and that, in the known execution, in correspondence of the rear part of the slide, are presenting the disadvantage that the bobbin thread is not sufficiently guided and sometimes is dragged by the passage of the needle thread during the sewing operation.

An advantage of the hook of the present invention is that it can be applied to all existing sewing machines without having to modify their stitching organs and without requiring any modification to a sewing machine available on the market. Also the bobbin case comprising the improved slide of the present invention can be applied to all existing hooks without having to modify them.

In addition, a hook or a bobbin case realized according to the invention are completely interchangeable with a known hook or respectively a known bobbin case, they do not need any modification of the areas destined for the passage of the thread and contain in itself all construction characteristics necessary to implement the invention.

BRIEF DESCRIPTION OF THE DRAWINGS

The invention will now be described with reference to exemplifying but non limiting embodiments, described in the appended figures, wherein:

FIG. 1 shows an exploded view of a Central Bobbin hook (CB-shuttle) complete with bobbin case, known;

FIG. 2 shows an exploded view of a complete rotary hook with bobbin case, known;

DETAILED DESCRIPTION OF THE INVENTION

Since, as mentioned, the changes of a complete hook according to the present invention compared to a known complete hook, affect only its bobbin case and the relative slide, in the following will be illustrated in the figures and descriptions, only the bobbin cases and the relative slides according some embodiments of the present invention, omitting, for simplicity, to represent every time the rest of the complete hook.

FIGS. 5*a*-5*e* show an embodiment of the bobbin case comprising an improved slide, composed of multiple components, according to the invention, with the presence of a flat slide body and a slide's claw made separately with a "C-bent" thin metal sheet and fixed to the slide body by means of an interlock in a groove formed on the underside of the slide body. The secondary component is mounted in the interlock before the insertion of the slide body into the guide on the bobbin case and remains fixed there once the slide body is inserted into said guide.

Figure 5A:
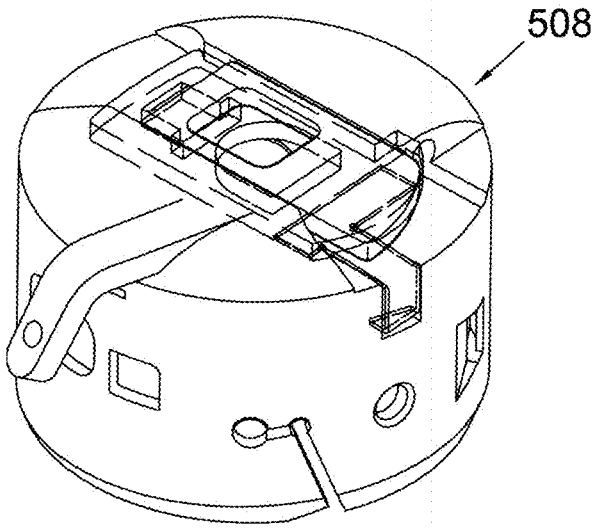
FIGS. 5*a* and 5*b* show an embodiment of the bobbin case according to the present invention respectively in perspective and exploded view.
Figure 5B:
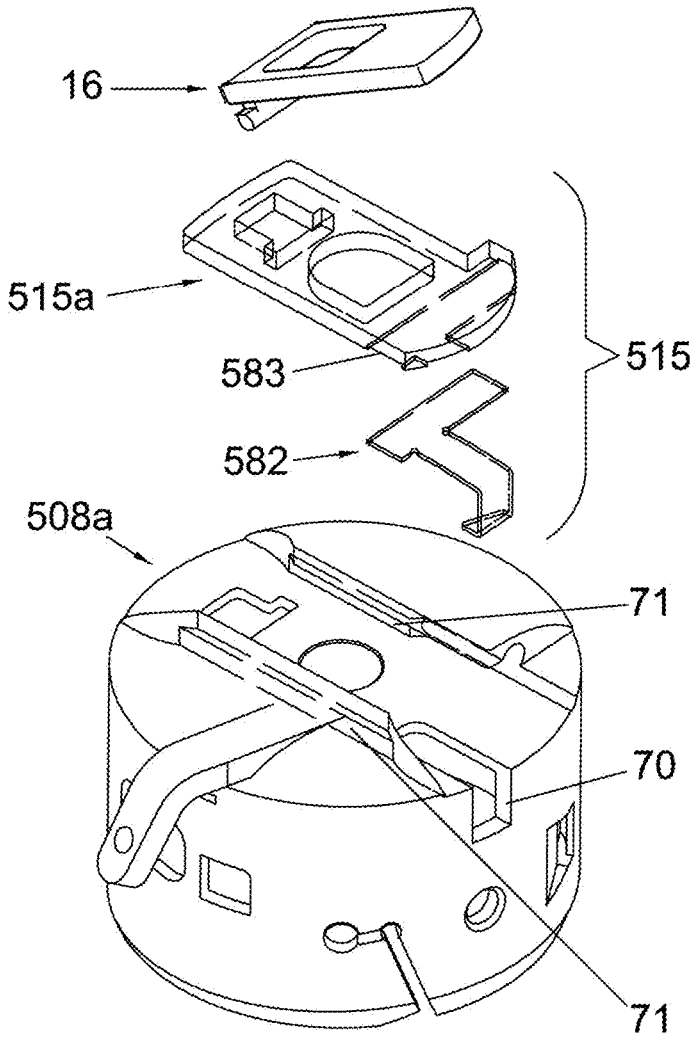
Figure 5C:
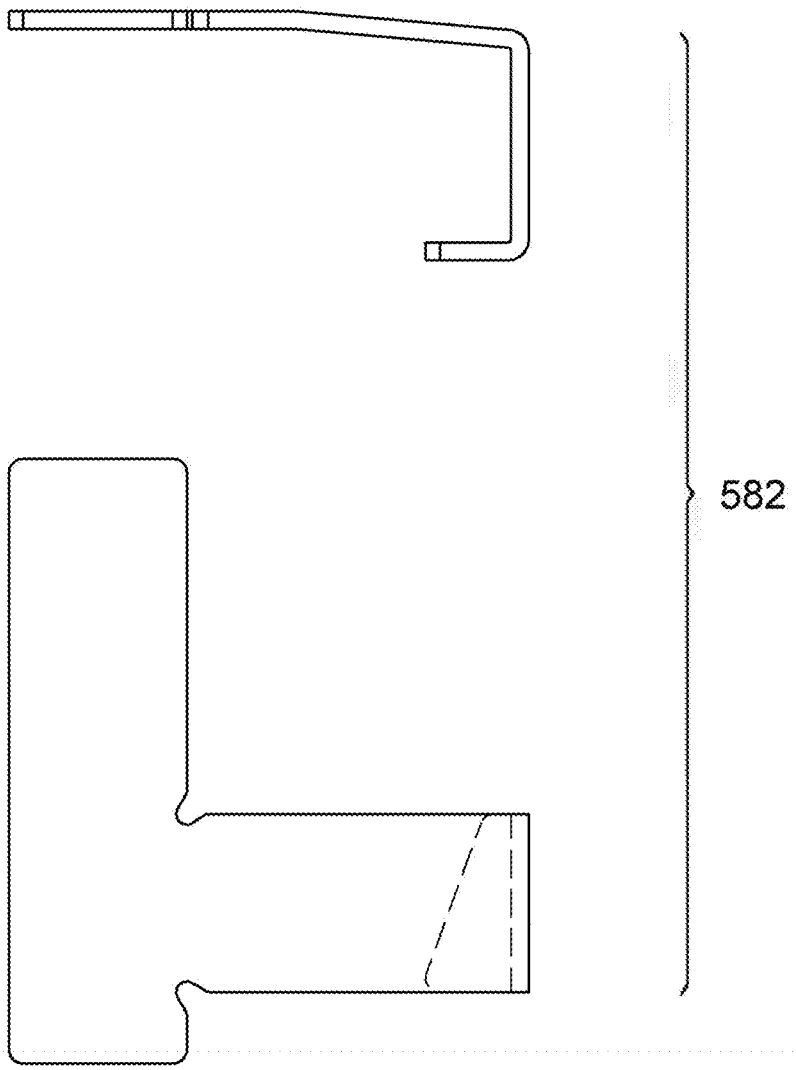
FIG. 5*c* shows the slide claw illustrated in FIG. 5*b;*
Figure 5D:
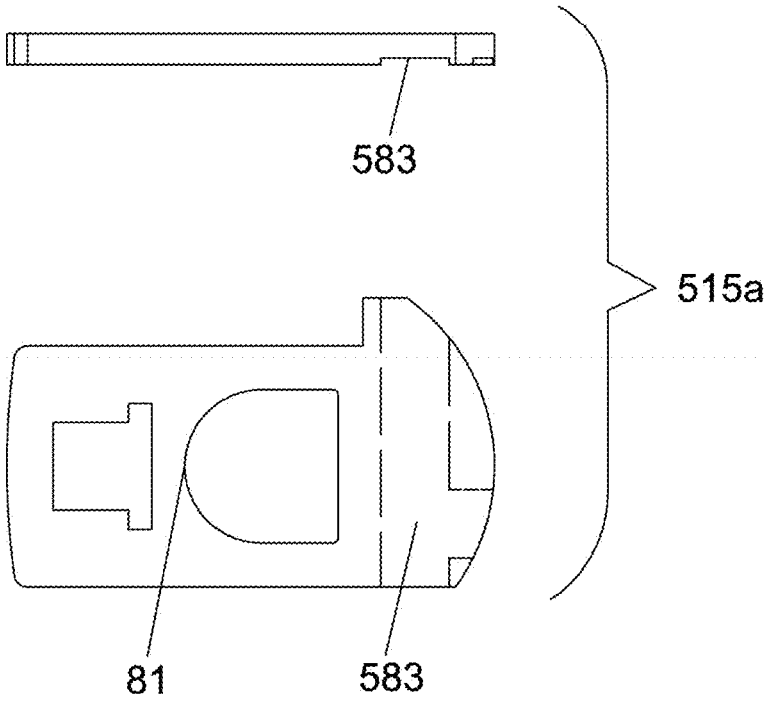
FIG. 5*d* shows the slide body illustrated in FIG. 5*b;*
Figure 6D:
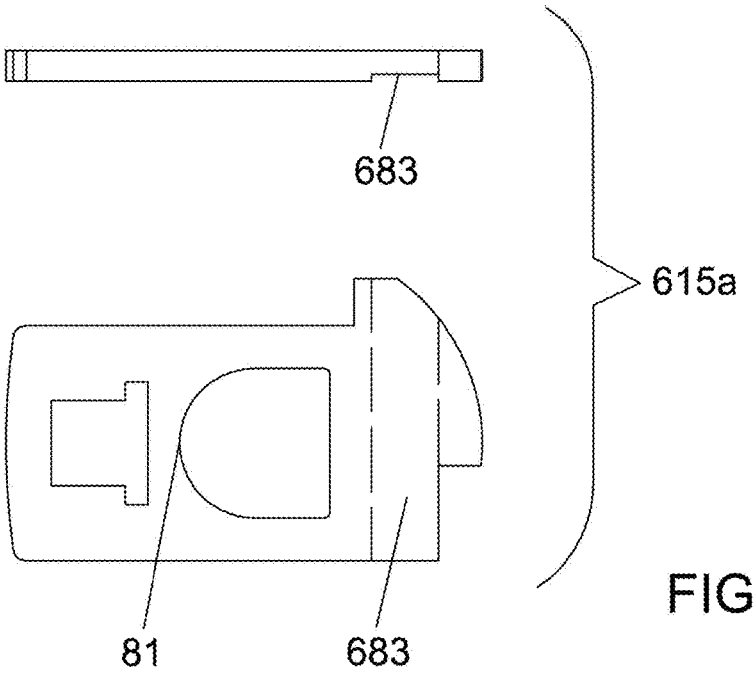
FIG. 6*d* shows a modification of the slide body illustrated in FIG. 5*d* according to the present invention.

FIG. 6*d* shows a different embodiment of the slide body shown in the previous FIG. 5*d*, from which it differs only by the simplified shape of the groove formed on the underside of the slide body for the interlocking of the secondary component of the slide's claw. This groove is easier to implement because it is produced by a single straight groove on the underside of the slide body (while in the execution of the groove according to FIG. 5*d*, the groove had a "T" shape).

Figure 7:
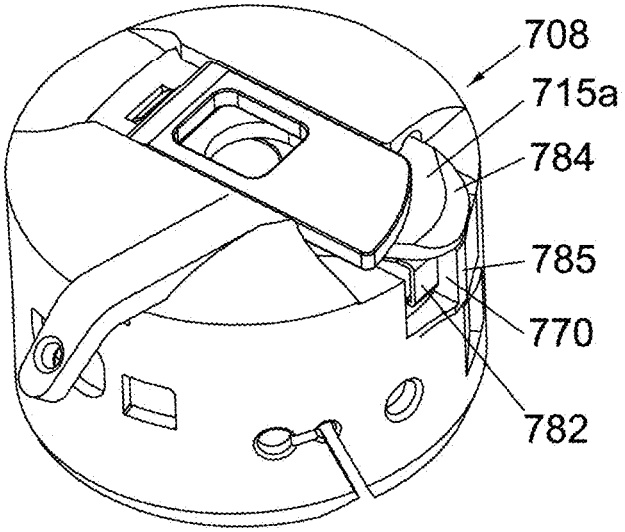
FIG. 7 shows a perspective view of another embodiment of the bobbin case according to the present invention.

FIG. 7 shows a different embodiment of the bobbin case according to the invention, similar to that shown in the preceding FIGS. 5*a*-5*e*, from which it differs only by the front of the slide body that is longer than the maximum protrusion of the component constituting the slide's claw and that in the forward position at rest of the slide overlaps the opening formed in the wall of the bobbin case for the passage of the slide's claw, and cooperates herewith with the bobbin case wall to create the continuity of the profile to support the passage of the needle thread, that the opening on the wall interrupted. The embodiment shown in this figure presents also a protuberance on the outer wall of the bobbin case in correspondence to the position of the slide's claw.

Figure 8A:
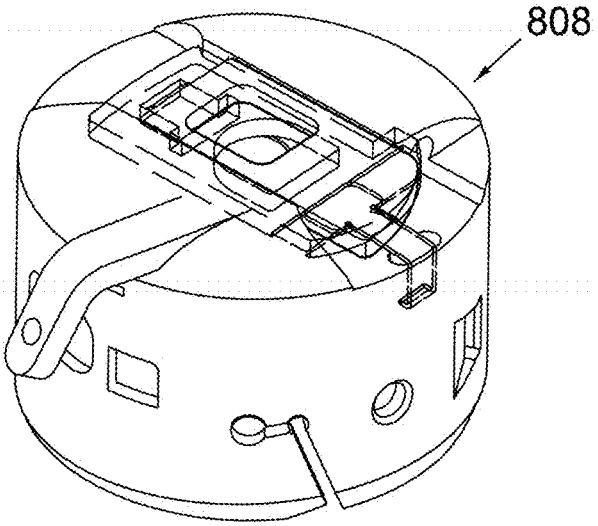
FIGS. 8*a*, 8*b*, and 8*e* show another embodiment of the bobbin case according to the present invention, respectively in perspective, exploded, and top views.
Figure 8B:
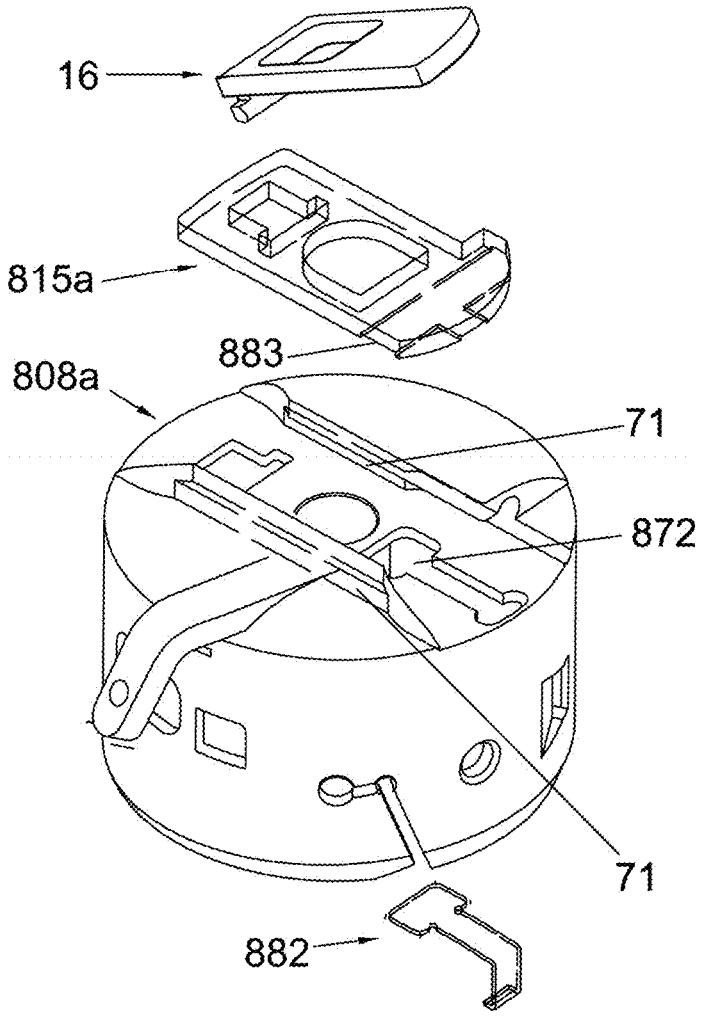
Figure 8E:
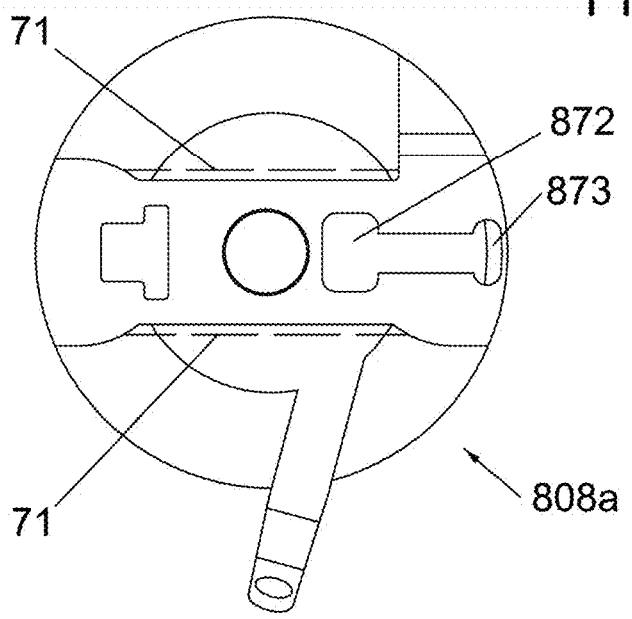

FIGS. 8*a*, 8*b*, 8*e* show a different embodiment of the bobbin case according to the invention, comprising an improved slide, composed of multiple components, with the presence of a slide body and a slide's claw made separately with a thin "C-bent" sheet and fixed to the slide body by means of an interlock in a groove formed on the underside of the slide body. The secondary component is mounted into the interlock after the insertion of the slide body into the guide on the bobbin case in a retracted position of the slide body beyond its backwards working stroke's end point and remains fixed to the slide body once the translation of the slide body is limited to its working stroke by means of the assembly of the lever.

The secondary component constituting the slide's claw, in this embodiment is mounted from inside the well of the bobbin case after the insertion of the slide body into the guide on the bobbin case, while the slide body is in a retracted position. This embodiment avoids to have the through opening in the wall of the bobbin case, as it is sufficient a recess formed in the thickness of said wall to house the slide's claw in the forward position at rest of the slide, thus being realized the continuity of the profile of the bobbin case wall to support the passage of the needle thread.

Figure 9A:
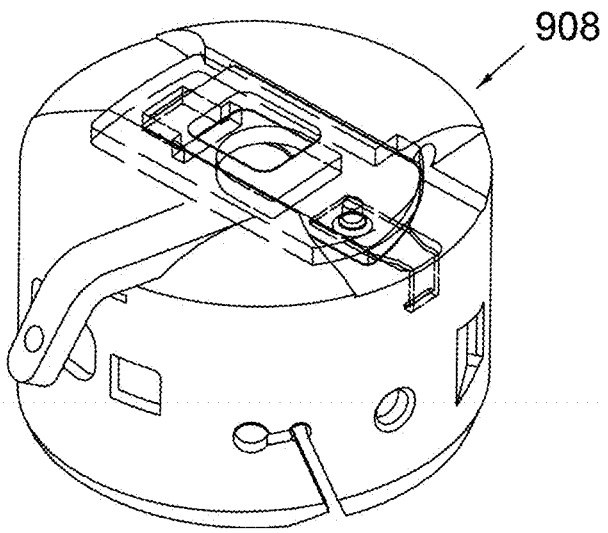
FIGS. 9*a*, 9*b*, and 9*e* show another embodiment of the bobbin case according to the invention, respectively in perspective, exploded, and top views.
Figure 9B:
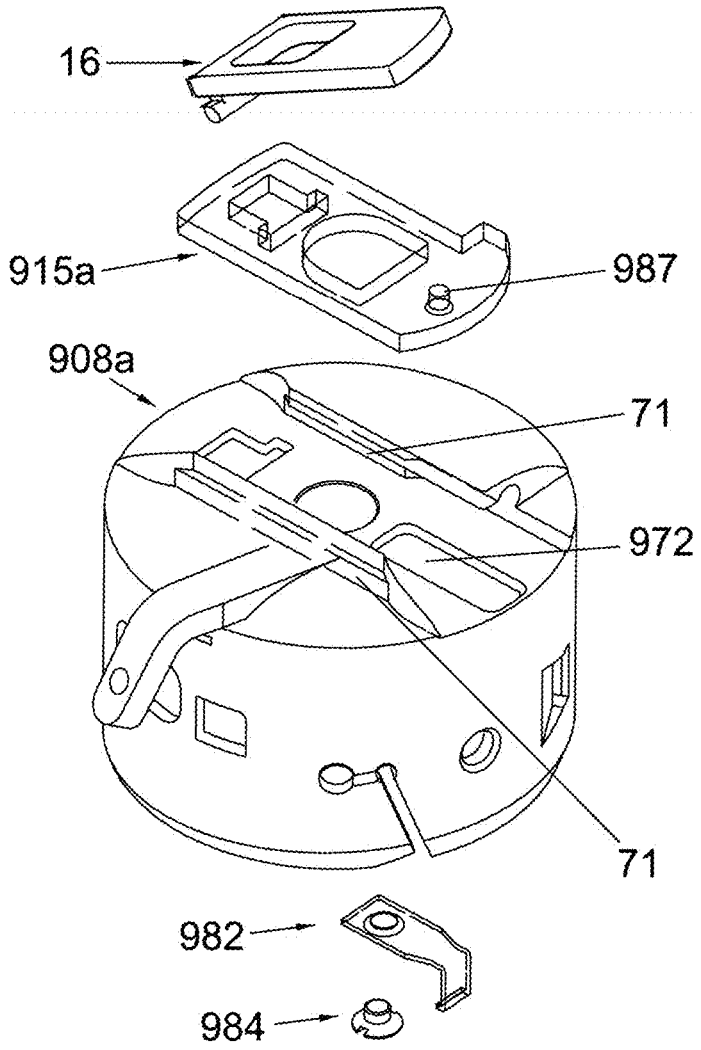
Figure 9E:
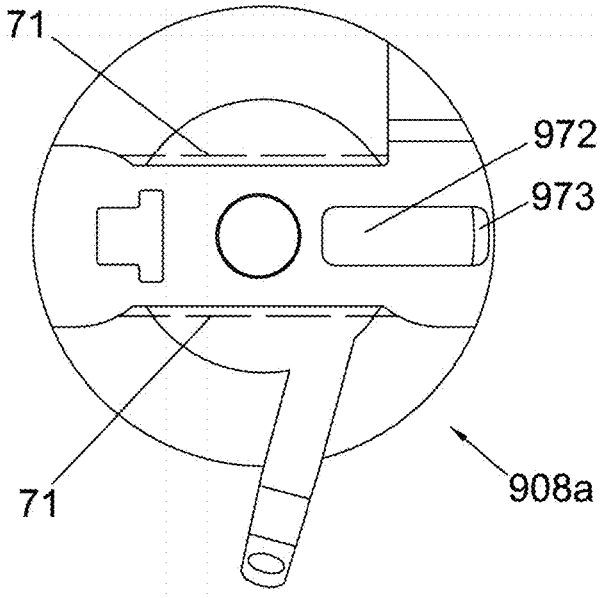

FIGS. 9*a*, 9*b*, 9*e* show a different embodiment of the bobbin case according to the invention, similar to that shown in the preceding FIG. 8, from which it differs only by the way of fixing to the body slide the secondary component constituting the slide's claw, which in this embodiment takes place through a screw. Also in this embodiment, the secondary component is mounted from the inside of the well of the bobbin case after the insertion of the slide body into the guide on the bobbin case.

Figure 10A:
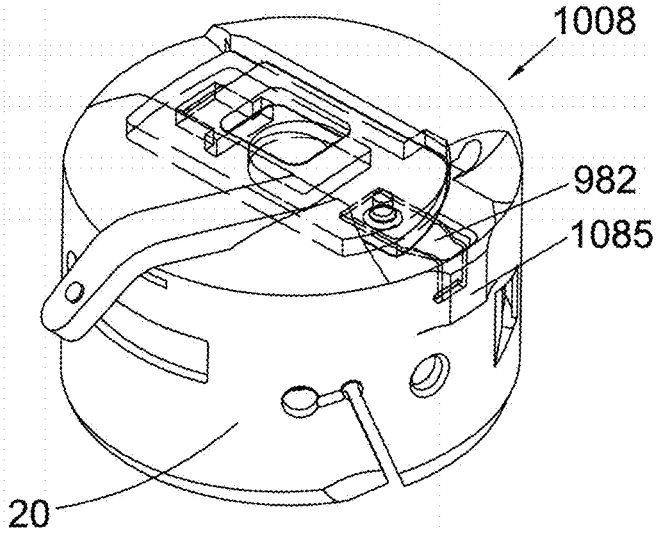
FIGS. 10*a* and 10*e* show another embodiment of the bobbin case according to the present invention, respectively in perspective and top views.
Figure 10E:
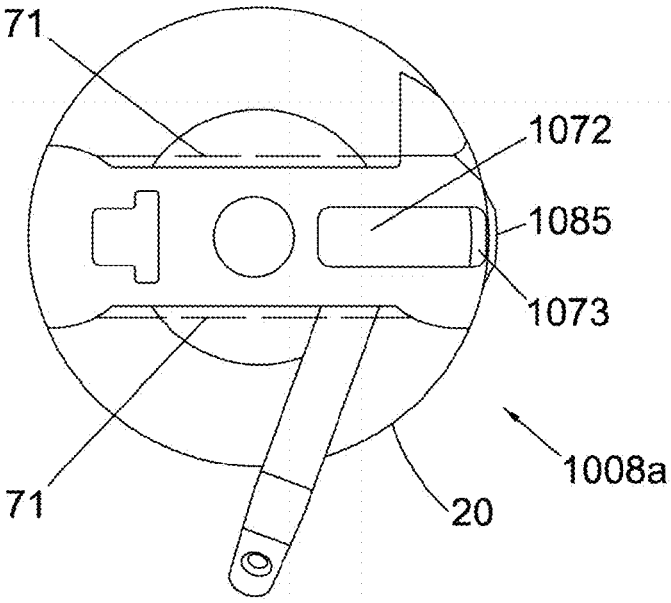
Figure 11A:
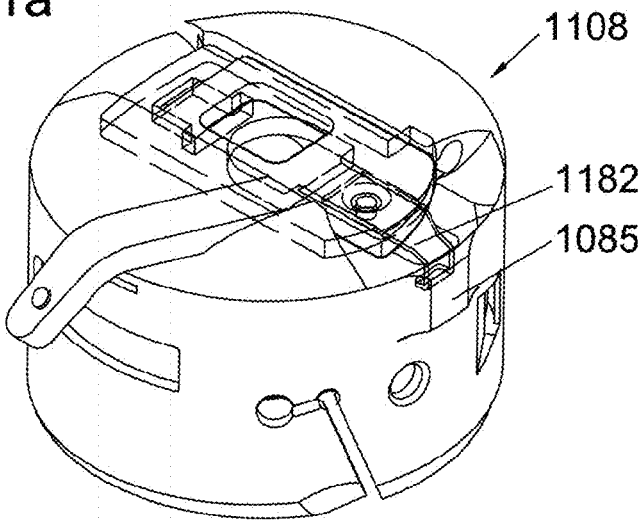
FIGS. 11*a* and 11*b* show another embodiment of the bobbin case according to the present invention, respectively in perspective and top views.
Figure 11B:
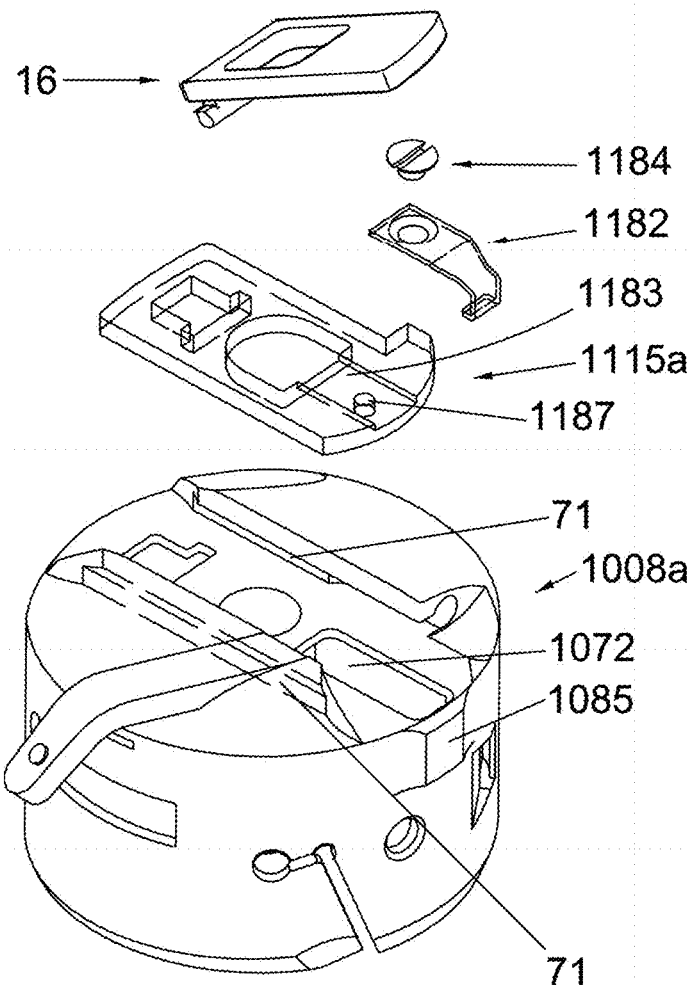
Figure 11C:
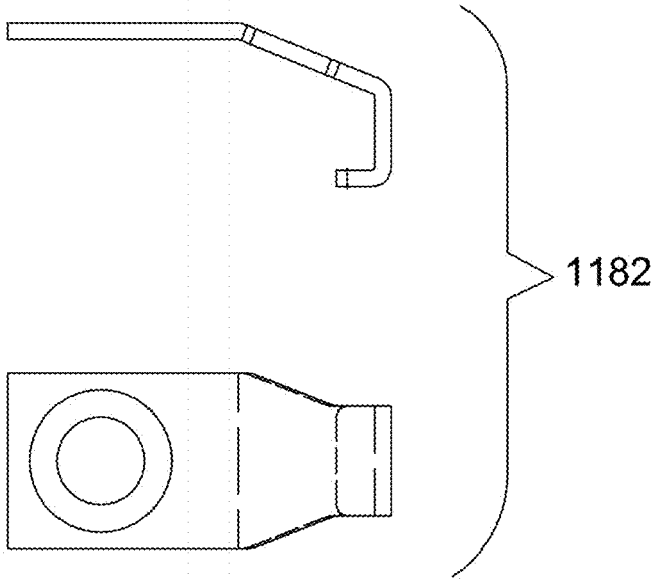
FIG. 11*c* shows the slide claw illustrated in FIG. 11*b;*
Figure 11D:
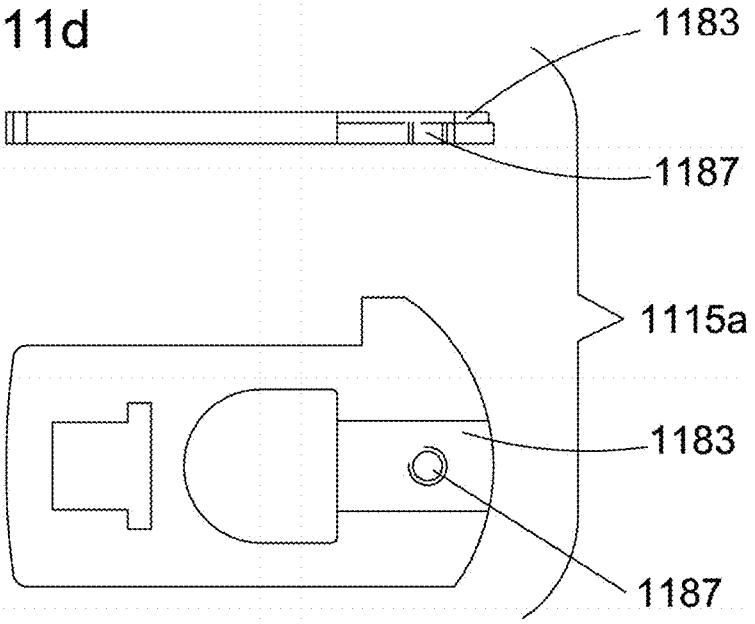
FIG. 11*d* shows the slide body illustrated in FIG. 11*b;*
Figure 12A:
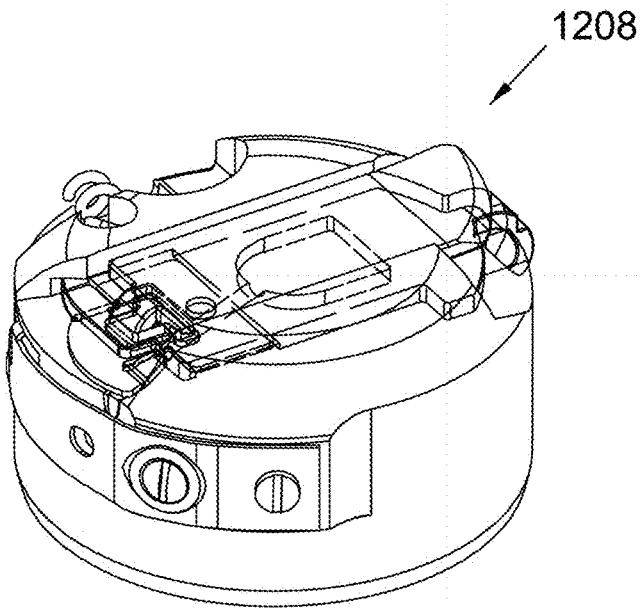
FIGS. 12*a* and 12*b* show another embodiment of the bobbin case according to the present invention, respectively in perspective and top views.
Figure 12B:
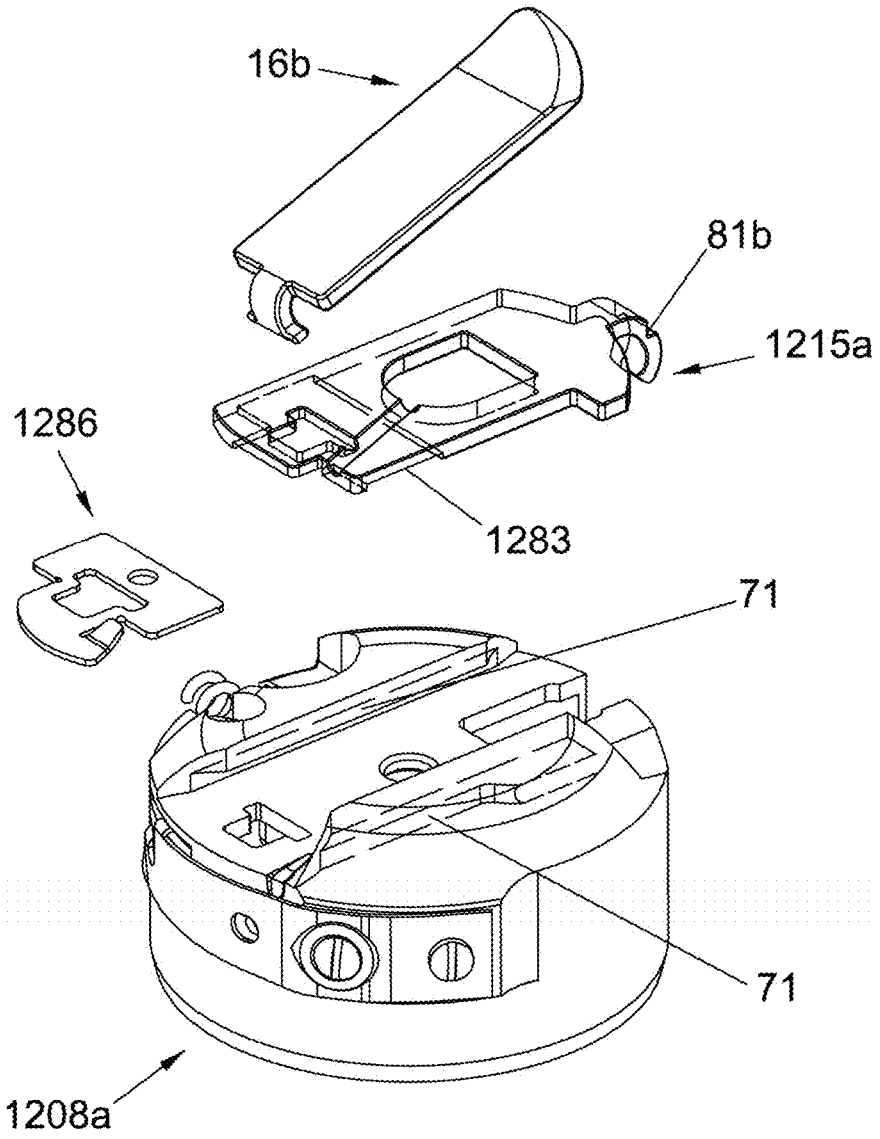
Figure 12C:
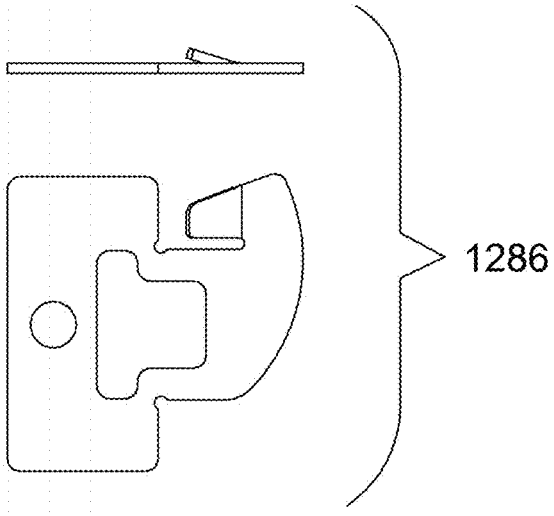
FIG. 12*c* shows the slide claw illustrated in FIG. 12*b;*
Figure 12D:
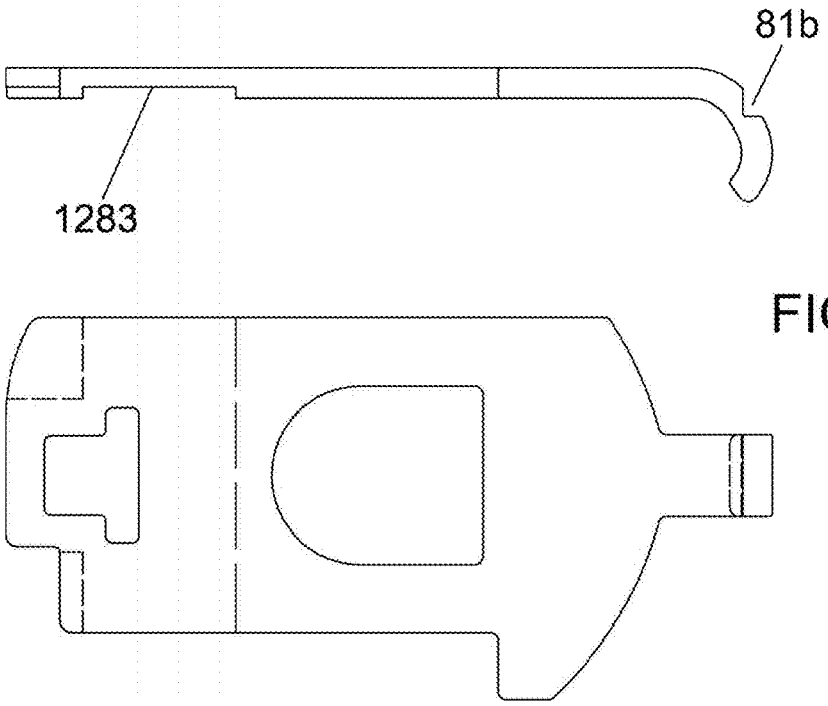
FIG. 12*d* shows the slide body illustrated in FIG. 12*b.*

FIGS. 10*a*, 10*e* show a different embodiment of the bobbin case according to the invention, similar to that shown in the preceding FIG. 9, from which it differs only by the presence of a protuberance on the outer wall of the bobbin case in correspondence to the position of the slide's claw and the relative recess on the inside of the bobbin case's wall, which can be deeper thanks to the increase of thickness of the bobbin case's wall in this area due to the protuberance.

FIGS. 11*a*-11*d* show a different embodiment of the bobbin case according to the invention, similar to that shown in the preceding FIG. 10, from which it differs only by the assembling way of the secondary component constituting the slide's claw, that also in this embodiment is mounted after the insertion of the slide body into the guide on the bobbin case, but this time it is mounted from the outside of the bobbin case, i.e. from above the slide, instead from the inside of the well of the bobbin case.

FIGS. 12*a*-12*d* show a different embodiment of the bobbin case comprising an improved slide, composed of multiple components, according to the invention, with the presence of a slide body and a component, which performs the function of guide or protection of the thread that is fixed to the slide body by means of an interlock in a groove formed on the underside of the slide body. The secondary component is mounted in the interlock before the insertion of the slide body into the guide on the bobbin case and remains fixed there once the slide body is inserted into said guide. Said secondary component is fixed to the rear side of the slide (opposite to the slide's claw) and has the function to guide and to protect the bobbin thread in the rotary hooks designed for coreless bobbins and bobbin cases and baskets without central shaft, in which the bobbin thread exits from the center of the bobbin case and passes between the slide body and the lever.

In the appended Figures, corresponding elements will be identified by the same numerical references.

FIG. 1 shows schematically an exploded view of a Central Bobbin hook 11 with horizontal axis "α" of rotation, known, in which only the elements relevant to the present description have been identified by numerical references:

- a hook body 2, comprising a well 18 in which the bobbin case 8 complete with bobbin 4 is housed;

bobbin case 8 housed in the well 18 of the hook body 2, free to rotate within the hook body 2 and complete with slide 15 for the axial restraint of the bobbin case 8 to the hook body 2 to prevent accidental disassembly during sewing, with lever 16 that with its leverage system created on the slide 15 allows the operator to disengage the slide 15, and herewith the bobbin case 8, from the axial constraint to the hook body 2 to allow the removal of the bobbin case 8, and with the tension spring 9 to give tension to the bobbin thread (of which the graphical representation is omitted) wound on the bobbin 4 housed inside the bobbin case 8;

a bobbin 4, on which is wound the bobbin thread (not shown), is housed in the bobbin case 8 and is constrained within the hook body 2 by the mounting of the bobbin case 8 on the hook body 2.

FIG. 2 shows schematically an exploded view of a rotary hook 12 with horizontal axis "α" of rotation, known, in which only the elements relevant to the present description have been identified by numerical references:

a hook body 2;

a basket 6, free to rotate inside of the hook body 2 comprising: a well 18 of the basket 6 in which is housed the bobbin case 8 complete with bobbin 4;

a bobbin case 8 housed in the well 18 of the basket 6, complete with slide 15 for the axial constraint of the bobbin case 8 to the basket to prevent accidental disassembly during the sewing operation, and complete with lever 16 that with its leverage system created on slide 15 allows the operator to disengage the slide 15, and herewith the bobbin case 8, from the axial constraint to the basket 6 to allow the removal of the bobbin case, and complete with tension spring 9 to give tension to the bobbin thread (whose graphical representation is omitted) wound on the bobbin 4 housed inside the bobbin case 8;

a bobbin 4, on which is wound the bobbin thread (not shown), is housed in the bobbin case 8 and is constrained within the basket 6 by the mounting of the bobbin case 8 on the basket 6.

Figure 3:
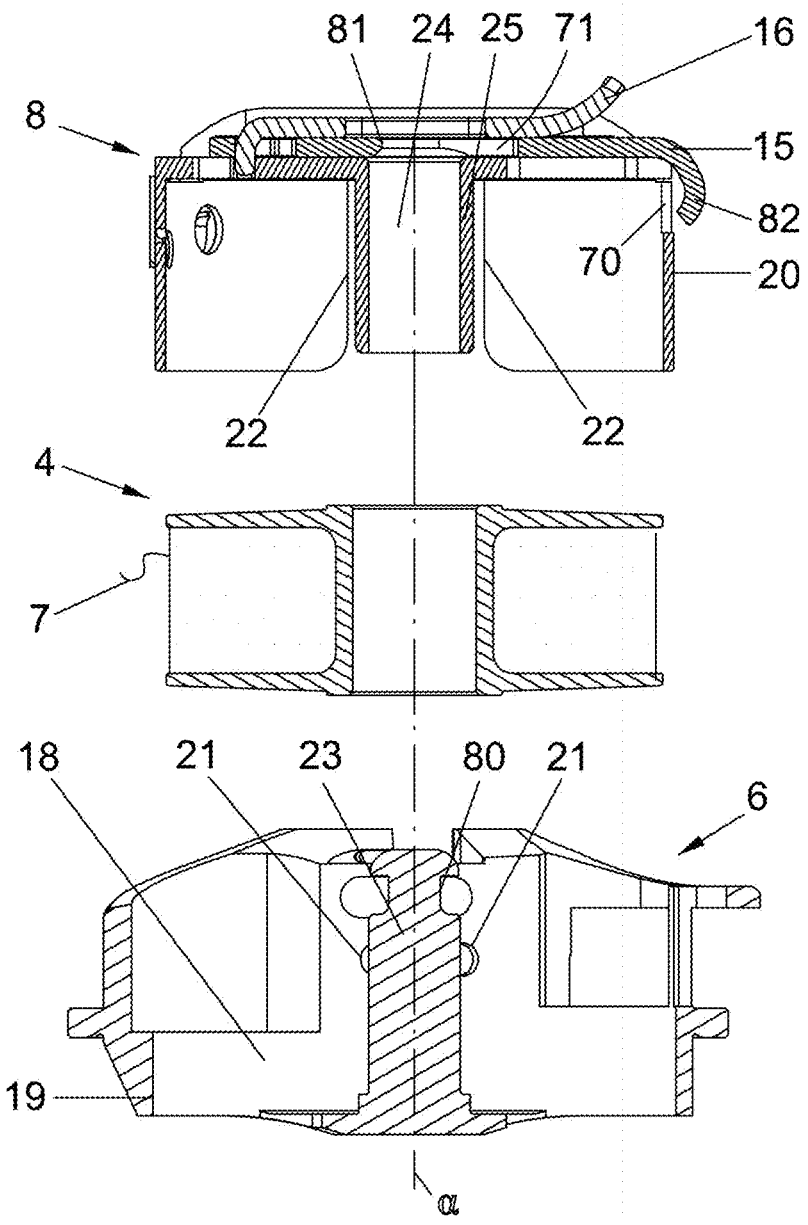
FIG. 3 shows only the bobbin case, the bobbin and the basket of the rotary hook as FIG. 2, known, disassembled and sectioned with a plane passing through the axis of rotation of the hook.

FIG. 3 shows the only sub-assemblies basket 6, bobbin 4 and bobbin case 8, of the rotary hook 12 of FIG. 2, known, sectioned on a plane passing through the axis of rotation "α". There are visible:

the basket 6 comprising a well 18 of the basket 6 apt to house the bobbin case 8 with inside the bobbin 4, an inner diameter 19 delimiting said well 18 of the basket 6 in which fits the outer diameter 20 of the bobbin case 8, a protrusion 21 on the inner diameter 19 of said well of the basket 6 that mating with the guide 22 on the outer diameter 20 of the bobbin case 8 allows the angular reference of the bobbin case 8 for the proper fitting of the bobbin case 8 on the basket 6, a shaft 23 on which the hole 24 of the shaft 25 of the bobbin case 8 is inserted, an undercut formed by a groove 80 on shaft 23 with which the slide 15 is constrained when the bobbin case 8 is mounted on the basket 6;

a bobbin case 8, complete with slide 15 and lever 16 (shown in the forward position at rest, as when the bobbin case is mounted on the basket) and comprising an outer diameter 20, a guide 22 on the outer diameter 20 of the bobbin case 8 and parallel to axis "α", which mating with the protrusion 21 on the inner diameter 19 of the well 18 of the basket 6 allows the angular reference for proper fitting of the bobbin case 8 on the basket 6, a shaft 25 with a coaxial hole 24, a slide's claw 82 on the front of the slide 15, an edge 81 of the central hole of the slide that cooperates with the undercut formed by the groove 80 on the shaft 23 of the basket 6 to constrain the slide 15 when the bobbin case 8 is mounted on the basket 6, a through opening 70 on the wall of the bobbin case and on the outer diameter 20 of the bobbin case to pass the slide's claw 82, a guide 71 for guiding the slide;

a bobbin 4, on which is wound the bobbin thread 7, which must be housed in the bobbin case 8 and is then constraint inside the basket 6 when the bobbin case 8 is mounted on the basket 6.

Figure 4:
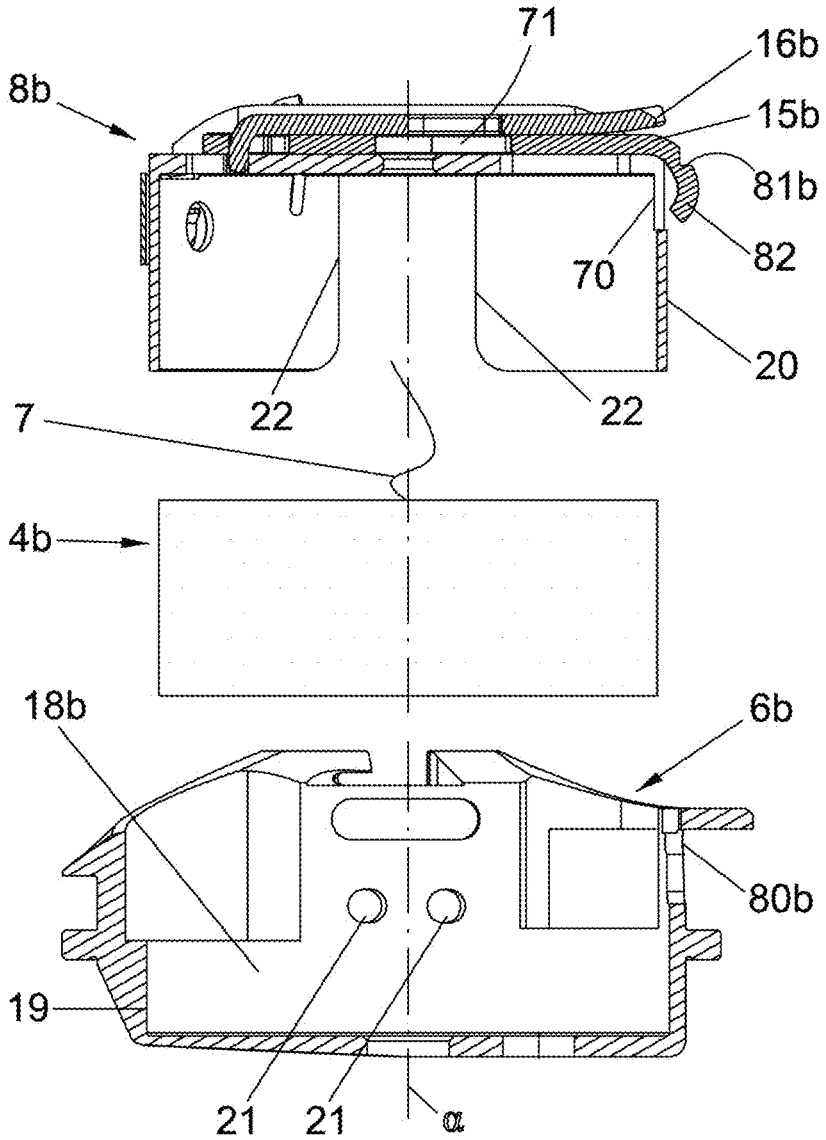
FIG. 4 shows another embodiment of the bobbin case, the bobbin and the basket of the rotary hook of FIG. 2 for coreless bobbins, known, disassembled and sectioned with a plane passing through the axis of rotation of hook.

FIG. 4, like the previous FIG. 3, shows the only sub-assemblies basket **6*b*, bobbin 4*b* and bobbin case 8*b*, of the rotary hook 12 of FIG. 2, known, but this time in the execution, also known, for coreless bobbins 4*b*, sectioned on the same plane passing through the axis of rotation "a" as in FIG. 3. These known bobbins 4*b* are generally composed merely of pre-wound and compacted bobbin thread 7, so as not to need a metal or synthetic core. The exit of the bobbin thread 7 from the bobbin 4*b*, is generally axially rather than tangentially as for the traditional bobbins 4**.

In FIG. 4 are visible:

the basket **6*b* comprising a well 18*b* of the basket 6*b* apt to house the bobbin case 8*b* complete with bobbin 4*b*, an inner diameter 19 delimiting said well 18*b* of the basket 6*b* in which fits the outer diameter 20 of the bobbin case 8*b*, a protrusion 21 on the inner diameter 19 of said well 18*b* of the basket 6*b*, which mating with the guide 22 on the outer diameter 20 of the bobbin case 8*b* allows the angular reference of the bobbin case 8*b* for the proper fitting of the bobbin case 8*b* on the basket 6*b*, an undercut formed by a groove 80*b* on the inside diameter 19 of the well 18*b*, with which the slide 15*b* is constrained when the bobbin case 8*b* is mounted on the basket 6*b***;

a bobbin case **8*b*, complete with slide 15*b* and lever 16*b* and comprising an outer diameter 20 of the bobbin case wall, a guide 22 on the outer diameter 20 of the bobbin case 8*b* and parallel to the axis "α", which mating with the protrusion 21 on the inner diameter 19 of the well 18*b* of the basket 6*b* allows the angular reference for the proper fitting of the bobbin case 8*b* on the basket 6*b*, a slide's claw 82 on the front of the slide 15*b*, an edge 81*b* formed on the front of the slide 15*b* that cooperates with the undercut formed by the groove 80*b* on the inner diameter 19 of the well 18*b* of the basket 6*b* to constrain the slide 15*b* when the bobbin case 8*b* is mounted on the basket 6*b*, a through opening 70 on the wall of the bobbin case and on the outer diameter 20 of the bobbin case to pass the slide's claw 82, a guide 71 for guiding the slide a bobbin 4*b*, consisting of pre-wound and compacted bobbin thread, so as not to need a metal or synthetic core, which must be housed in the bobbin case 8*b* and is then constraint inside the basket 6*b* when the bobbin case 8*b* is mounted on the basket 6*b***.

Figure 5E:
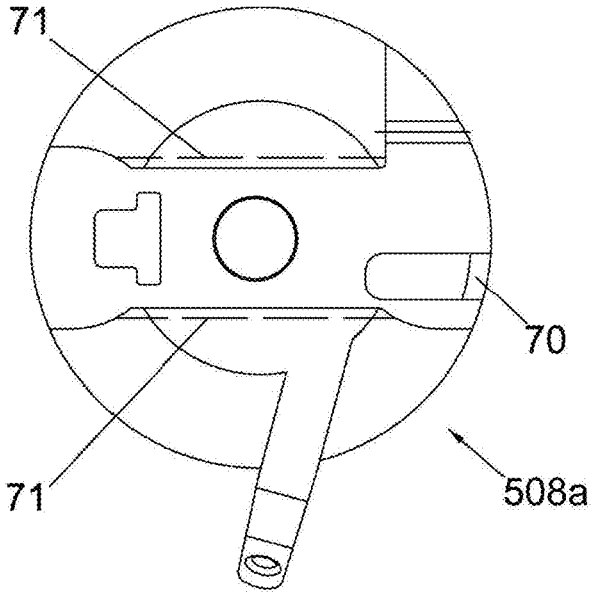
FIG. 5*e* shows a top view of the bobbin case of FIG. 5*b;*

FIGS. **5*a*-5*e* show an embodiment of the bobbin case 508 comprising an improved slide 515, composed of multiple components, according to the invention, with the presence of a flat slide body 515*a* and a slide's claw 582 made separately with a "C-bent" thin sheet and fixed to the slide body 515*a* by means of an interlock in a groove 583 formed on the underside of the slide body 515*a*. The secondary component 582 is mounted in the interlock 583 before the insertion of the slide body 515*a* into the guide 71 on the bobbin case and remains fixed there once the slide body is inserted into said guide. FIG. 5*a* shows the mounted bobbin case, FIG. 5*b*** shows the same bobbin case with the components exploded, FIG. 5*c* shows only the slide's claw 582, FIG. 5*d* shows only the slide body 515*a* with the relative details and FIG. 5*e* shows only the body of the bobbin case 508*a*.

FIG. 6*d* shows a different embodiment of the slide body 615*a* compared to the previous FIG. 5*d*: it varies from that one only for the simplified form of the groove 683 formed on the underside of the slide body 615*a* for the interlock of the secondary component of the slide's claw. This groove is easier to implement because it is made by a single straight groove on the underside of the slide body (while in the execution of the groove according to FIG. 5*d*, the groove had the shape of a "T").

FIG. 7 shows a different embodiment of the bobbin case 708 according to the invention, similar to that 508 of the preceding FIGS. 5*a*-5*e* and varies from that one only for the front part 784 of the slide body 715*a* that is longer than the maximum protrusion of the component 782 constituting the slide's claw and that in the forward position at rest of the slide overlaps the opening 770 formed in the wall of the bobbin case for the passage of the slide's claw 782, and cooperates herewith with the bobbin case wall to create the continuity of the profile, to support the passage of the needle thread, that the opening on the wall was interrupting. In the embodiment shown in these figures is present also a protuberance 785 on the outer wall of the bobbin case in correspondence to the position of the slide's claw 782.

FIGS. 8*a*, 8*b*, 8*e* show a different embodiment of the bobbin case 808 according to the invention, comprising an improved slide, composed of multiple components, with the presence of a flat slide body 815*a* and a slide's claw 882 made separately with a "C-bent" thin metal sheet and fixed to the slide body by means of an interlock in a groove 883 formed on the underside of the slide body 815*a*. The secondary component 882 is mounted in the interlock 883 after the insertion of the slide body 815*a* into the guide 71 on the bobbin case 808*a* in a retracted position of the slide body beyond its backwards working stroke's end point and remains fixed to the slide body 815*a* once the translation of the slide body 815*a* is limited to its working stroke by means of the assembly of the lever 16. Appropriate openings 872 are present on the inside bottom of the bobbin case body 808*a*, only for the purpose to mount the secondary component 882 in the retracted position of the slide beyond its backwards working stroke's end point. As can be seen from FIG. 8*e* of the bobbin case body 808*a*, this embodiment avoids to have the through opening in the wall of the bobbin case and is sufficient to have a recess 873 formed in the thickness of said wall to house the slide's claw 882 in the forward position at rest of the slide, thus being realized the continuity of the profile on the bobbin case wall to support the passage of the needle thread. Note that in this representation the wall thickness of the bobbin was not increased in correspondence to the recess 873.

FIGS. 9*a*, 9*b*, 9*e* show a different embodiment of the bobbin case 908 according to the invention, similar to that 808 of the preceding FIGS. 8*a*, 8*b*, 8*e* and that varies from these only for the fixing method of the secondary component constituent the slide's claw 982 to the slide body 915*a*, which in this embodiment is realized by means of a screw 984 that is screwed into a threaded hole 987 realized on the slide body 915*a* on which, on the opposite, is absent the groove for the interlocking. Also in this embodiment the secondary component 982 and the screw 984 are mounted from the inside of the well of the bobbin case after the insertion of the slide body 915*a* into the guide 71 on the bobbin case. The appropriate openings 972 on the inner bottom of the bobbin case body 908*a* are simplified compared to those of the bobbin case 808 previously described. As can be noticed from FIG. 9*e* of the bobbin case body 908*a*, also in this embodiment the through opening in the wall of the bobbin case has been avoided and the recess 973 formed in the thickness of said wall is sufficient to house the slide's claw 982 in the forward position at rest of the slide. Note that also in this representation the wall thickness of the bobbin case was not increased in correspondence to the recess 973.

FIGS. 10*a*, 10*e* show a different embodiment of the bobbin case 1008 according to the invention, similar to that shown in the preceding FIGS. 9*a*, 9*b*, 9*e*, from which it differs only by the presence of a protrusion 1085 on the outer diameter 20 of the wall of the bobbin case body 1008*a* in correspondence to the recess 1073 to house the slide's claw 982 and by its recess 1073 on the inside of the wall of the bobbin case body, which can thus also be deeper, without the risk of making the bobbin case wall too thin at that point, with embrittlement of the same.

FIGS. 11*a*-11*d* show a different embodiment of the bobbin case 1108 according to the invention, similar to that shown in the preceding FIGS. 10*a*, 10*e*, from which it differs only by the slide body 1115*a*, the slide's claw 1182 and the assembling way of the secondary component constituting the slide's claw 1182, that also in this embodiment is mounted after the insertion of the slide body 1115*a* into the guide 71 on the bobbin case body 1008*a*, but this time it is mounted from the outside of the bobbin case, i. e. from above the slide, instead from inside the well of the bobbin case. In the implementation shown, the secondary component 1182 is mounted on the slide body 1115*a* by means of both an interlock in a groove 1183 formed in the upper side of the slide body, and a screw 1184 that is screwed into a threaded hole 1187 realized on the slide body 1115*a*. In the implementation shown, the bobbin case body 1008*a* is the same of the previous FIG. 10*e*, but in this case the through opening on the inner bottom of the well of the bobbin case, serves to pass only the part of the slide's claw that must interact with the bobbin and not the whole secondary component for its mounting on the slide body.

FIGS. 12*a*-12*d* show a different embodiment of the bobbin case 1208 comprising an improved slide, composed of multiple components, according to the invention, with the presence of a slide body 1215*a* and a component 1286 that performs the function of guide and protection of the bobbin thread and that is fixed to the slide body by means of an interlock in a groove 1283 formed on the underside of the slide body 1215*a*. The secondary component 1286 is mounted into the interlock before the insertion of the slide body 1215*a* into the guide 71 on the bobbin body 1208*a* and remains fixed there once the slide body is inserted into said guide. Said secondary component is fixed to the rear part of the slide (opposite to the slide's claw) and performs the function to guide and to protect the bobbin thread in the rotary hooks designed for coreless bobbins and bobbin cases and baskets without shaft, where the bobbin thread exits from the center of the bobbin case and passes between slide body and lever.

Naturally, the invention is not limited to the particular embodiments previously described and illustrated in the appended Figures, but it can be subject to numerous modifications of detail within the reach of a person skilled in the art, without departing from the scope of the invention itself, as defined in the appended claims.

The invention claimed is:

1. A rotary or Central Bobbin (CB-shuttle) hook for a lockstitch sewing machine, the hook comprising:

a bobbin case including a slide and a lever, said slide comprising multiple primary components including a slide body housed in a guide of the bobbin case, the lever moving in relation to the slide body to provide leverage for disengagement of the slide, and at least one secondary component connected to said slide body and separate from said slide body.

2. The hook according to claim 1, wherein said at least one secondary component is connected to the slide body by one or more of gluing, clinching, riveting, interlocking, and screwing using one or more screws.

3. The hook according to claim 1, wherein said at least one secondary component is mounted on the slide body before the insertion of the slide body into the guide on the bobbin case, by at least one interlock in a groove formed on the underside of the slide body.

4. The hook according to claim 1, wherein said at least one secondary component is mounted on the slide body after the insertion of the slide body into the guide on the bobbin case.

5. The hook according to claim 1, wherein said at least one secondary component connected to the slide body and separate from the slide body is a slide claw separate from the slide body.

6. The hook according to claim 5, wherein a front part of the slide body is longer than the maximum protrusion of said secondary component and overlaps an opening formed in a wall of the bobbin case for the passage of the slide claw, and cooperates with said bobbin case wall to create the continuity of the profile to support the passage of the needle thread.

7. The hook according to claim 1, wherein the continuity of the profile of the bobbin case to support the passage of the needle thread is realized by a bobbin case wall.

8. The hook according to claim 7, further comprising a recess formed in the inner diameter of the bobbin case wall, the recess being contained within the thickness of said wall, the recess configured to receive the slide claw in a forward position at rest of the slide.

9. The hook according to claim 1, wherein said at least one secondary component connected to the slide body and separate from the slide body is an element configured to guide and protect the bobbin thread.

10. A bobbin case of a rotary or Central Bobbin (CB-shuttle) hook for a lockstitch sewing machine, the bobbin case including a slide and a lever, said slide comprising:

multiple primary components including a slide body housed in a guide of the bobbin case, the lever moving in relation to the slide body to provide leverage for disengagement of the slide, and at least one secondary component connected to said slide body and separate from said slide body.

11. The hook according to claim 5, wherein the slide claw separate from the slide body is made of a sheet bent into a C-shape, the sheet having a thickness less than the thickness of the slide body.

* * * * *